US005309975A

United States Patent [19]

Ohnishi et al.

[11] Patent Number: 5,309,975

[45] Date of Patent: May 10, 1994

[54] DIFFERENTIAL PRESSURE CASTING PROCESS

[75] Inventors: Nobuaki Ohnishi, Ibaragi; Yasuo Iizuka, Saitama; Yoshihisa Konishi, Tochigi, all of Japan

[73] Assignee: Hitachi Metals, Ltd., Chiyoda, Japan

[21] Appl. No.: 963,489

[22] Filed: Oct. 20, 1992

[30] Foreign Application Priority Data

Oct. 22, 1991 [JP] Japan ..... 3-304257
Oct. 22, 1991 [JP] Japan ..... 3-304258
Nov. 1, 1991 [JP] Japan ..... 3-315412

[51] Int. Cl.[5] ..... B22D 18/04
[52] U.S. Cl. ..... 164/66.1; 164/119
[58] Field of Search ..... 164/457, 119, 66.1

[56] References Cited

U.S. PATENT DOCUMENTS 3,961,662 6/1976 Balevski et al. ..... 164/119

FOREIGN PATENT DOCUMENTS 48-49625 7/1973 Japan .
63-180360 7/1988 Japan ..... 164/119
1-104457 4/1989 Japan .
3-71964 3/1991 Japan .

OTHER PUBLICATIONS

English Abstract of Japanese Patent Laid Open No. 48-49625.

*Primary Examiner*—Kuang Y. Lin
*Attorney, Agent, or Firm*—Finnegan, Henderson, Farabow, Garrett & Dunner

[57] ABSTRACT

A split mold is closed to define a cavity. The mold has in its lower portion a gate communication with the cavity. A stoke is connected at its upper end to the gate, while its lower end is immersed in a bath of molten metal in a holding furnace. The pressure of the bath is increased, or the pressure of the cavity decreased, whereby the molten metal is introduced into the cavity. The molten metal in the cavity is allowed to solidify to yield a cast product. The product is cooled and removed from the mold. The stoke and the cavity are filled with an inert gas before the molten metal is introduced into the cavity. In order to introduce the molten metal into the cavity, a pressure difference is created between the bath and the cavity at a rate of 0.001 to 0.006 kgf/cm²/s. The molten metal is kept at a temperature which is higher than its melting point by 50° to 80° C., or the mold is kept at a temperature of 350° to 430° C. The inert gas is also supplied into the stoke to separate molten metal therein from the solidified product. The surface of the separated molten metal in the stoke is kept above that of the molten metal in the holding furnace when the product is cooled and removed from the mold.

5 Claims, 10 Drawing Sheets

DIFFERENTIAL PRESSURE CASTING PROCESS

BACKGROUND OF THE INVENTION

1. Field of the Invention

This invention relates to a process for differential pressure casting, and more particularly, to one which can produce castings of improved quality.

2. Description of the Prior Art

When a casting is produced from an easily oxidizable material, e.g., aluminum or its alloy, by e.g., a low pressure casting process, it is necessary to prevent the oxidation of molten aluminum or its alloy in a stoke, or to remove aluminum oxide therefrom. It has been usual for the low pressure casting of aluminum or its alloy to provide a gate in the lower portion of mold with a wire net for removing aluminum oxide. Although the wire net may retain coarse oxide particles, it allows the passage of fine oxide particles into a mold cavity, where they contact air and undergo further oxidation. The net needs to be changed to a new one after each casting operation. Moreover, the net adheres to a scrap of aluminum or its alloy cut from a cast product in the gate and thereby disables the effective use of the scrap.

There has been proposed a process for differential pressure casting in which an inert gas is supplied into the mold cavity prior to the pouring of molten metal thereinto for preventing its oxidation, as disclosed in, for example, Japanese Patent Application laid open under No. Sho 48-49625, or Hei 3-71964. This process makes it possible to prevent the oxidation of molten metal without relying upon any wire net provided in the gate. Japanese Patent Application laid open under No. Hei 1-104457 discloses a process for differential pressure casting which employs a stoke comprising an inner cylindrical wall having an upper end connected to the gate in the mold and a lower end kept above the surface of molten metal in a holding furnace, and an outer cylindrical wall having an upper end connected to the inner wall and a lower end immersed in the molten metal. Thus, the stoke has a cylindrical space having a closed upper end and an open lower end defined between the inner and outer walls. Further, the stoke has a hole communicating the cylindrical space with the outside of the stoke. Using this stoke an inert gas, that is heavier than air, is supplied through the hole to remove air from the stoke, gate and mold cavity, then the molten metal is introduced from the holding furnace into the mold cavity by a difference of pressure created therebetween.

The necessity of saving energy has been recently arousing greater efforts to achieve a reduction in weight of automobile parts. For example, aluminum alloy has come to be used instead of steel for making disk wheels. The demand for e.g., lightweight wheels has grown to the extent. However, it is necessary to consider even a reduction in thickness of aluminum alloy wheels. The mere reduction in thickness of aluminum alloy wheels results also in a lowering of their mechanical strength. It is, therefore, essential to be able to produce aluminum alloy wheels which are small in thickness and yet high in mechanical strength.

The process as proposed in Japanese Patent Application laid open under No. Sho 48-49625, or Hei 3-71964 can produce casting containing a smaller amount of oxide and therefore, having an improved mechanical strength. Their strength is, however, still insufficient for allowing any further reduction in thickness. The process disclosed in Japanese Patent Application laid open under Hei 1-104457 has a drawback of being unable to prevent the oxidation of the molten metal completely, insofar as the surface of the molten metal remains exposed to air until the inert gas is supplied into the stoke. The application contains a statement to the effect that the unsolidified part of the molten metal which has been raised from the holding furnace falls back into the furnace upon elimination of the difference of pressure maintained for raising the molten metal into the mold cavity. The space made open by the falling of the molten metal cannot be vacuum, but necessarily contains air. The purging of the space with the inert gas, which relies upon its specific gravity higher than that of air, requires a certain length of time. And whatever quickly the gas may be introduced, the surface of the molten metal in the holding furnace remains exposed to the air. The oxidation of the molten metal to some extent or other is, therefore, unavoidable. Moreover, the elimination of the difference of pressure does not result in the immediate falling of any and all unsolidified metal, since the gate is sealed by the metal without being completely solidified remaining in the upper portion of the gate. This brings about a delay in the cooling of a cast product near the gate which has an adverse effect not only on the efficiency of production, but also on the formation of a fine metallurgical structure.

SUMMARY OF THE INVENTION

It is, therefore, an object of this invention to provide a process for differential pressure casting which can produce aluminum alloy wheels, or other castings that are light in weight and yet have an improved mechanical strength.

It is another object of this invention to provide a process for differential pressure casting which makes it possible to prevent the oxidation of molten metal effectively.

We, the inventors of this invention, have studied possibilities of improving the differential pressure casting process in which an inert gas is supplied into a mold cavity before molten metal is poured thereinto, and found that there are certain conditions under which it is possible to improve the flowability of molten metal in the mold cavity.

According to a first aspect of this invention, which has been done in view of this improved flowability of molten metal, there is provided a casting process which comprises; employing a split mold defining a cavity when closed and having in its lower portion a gate communicating with the cavity, and a stoke having an upper end connected to the gate and a lower end immersed in a bath of molten active metal or its alloy in a holding furnace, increasing the pressure of the bath or decreasing the pressure of the cavity to create a pressure difference therebetween to introduce the molten metal or alloy into the cavity, and allowing the molten metal or alloy in the cavity to solidify to yield a cast product; wherein the stoke and the cavity are filled with an inert gas before the molten metal or alloy is introduced into the cavity, and the pressure difference is created at a rate of 0.001 to 0.006 $kgf/cm^2/s$.

According to a second aspect of this invention, which has been done also in view of the improved flowability of molten metal, the stoke and the cavity are filled with an inert gas before the molten metal or alloy is introduced into the cavity, and the molten metal or alloy has a temperature higher than its melting point by 50° to 80°

C. when introduced into the cavity, or in the event that the molten metal Or alloy is aluminum or its alloy, the mold is held at a temperature of 350° to 430° C.

According to a third aspect of this invention, there is provided a casting process which comprises; employing a split mold defining a cavity when closed and having in its lower portion a gate communicating with the cavity, and a stoke having an upper end connected to the gate and a lower end immersed in a bath of molten metal or its alloy in a holding furnace, raising the bath pressure to a level above the cavity pressure (whether by increasing the former pressure, or by decreasing the latter) to introduce the molten metal or alloy into the cavity, allowing the molten metal or alloy in the cavity to solidify to yield a cast product, and opening the mold to remove the product therefrom; wherein an inert gas is supplied into the stoke to effect the separation of the molten metal or alloy from the product, and the surface of the separated molten metal or alloy in the stoke is kept above that of the molten metal or alloy in the holding furnace when the product is cooled to solidify and removed from the mold.

It is well known that a metallic having a fine metallurgical structure has an improved mechanical strength. It is also known that the casting of molten metal at a low introducing speed into a mold cavity enables it to solidify in a highly orientated way and yield a solidified product having a fine structure. We have, however, found that in the atmospheric casting the molten metal entering the cavity forms at the leading end of its stream an oxide film which obstructs by its surface tension of the smooth flow of the molten metal in the cavity. This is particularly the case with those portions of the mold cavity which are smaller in thickness than any other portion thereof. Therefore, it has been necessary to use a sufficiently high introducing speed to enable molten metal to flow smoothly in the mold cavity in which air is present.

According to the first aspect of this invention, it is possible to achieve a lower introducing speed utilizing the improved flowability of molten metal, i.e., a lower rate at which the pressure difference is created for effecting the introduction of molten metal into the mold cavity. The casting circumstances are filled with an inert gas which prevents the formation of any oxide film at the leading end of a stream of molten metal, and thereby enables its improved flow and thereby the lower introducing speed. Thus, the cast product of this invention has a fine metallurgical structure and therefore it has improved mechanical strength. The pressure difference is created at a rate of 0.001 to 0.006 $kgf/cm^2/s$. If the rate is higher than 0.006 $kgf/cm^2/s$, it is impossible to obtain fine structure giving a satisfactorily improved strength, and if it is lower than 0.001 $kgf/cm^2/s$, there is every likelihood that the molten metal may not satisfactorily flow or fill the whole cavity.

A fine metallurgical structure can be obtained also by employing a high solidifying speed. However in the atmospheric casting, it has been impossible to employ a satisfactorily low molten metal temperature or mold temperature for realizing a satisfactorily high solidifying speed, since the oxide film as hereinabove stated hinders the smooth flow of the molten metal. More specifically, it has hitherto been considered necessary to employ a molten metal temperature which is higher than its melting point by 100° to 150° C. and a mold temperature of 480° to 500° C. in case for casting aluminum or an alloy thereof.

According to the second aspect of this invention, it is possible to employ a lower molten metal, or mold temperature utilizing the improved flowability of molten metal. The casting circumstances are filled with an inert gas which prevents the formation of any such oxide film as hereinabove stated, and thereby enables an improvement in the flowability of the molten metal and thereby the use of a lower molten metal, or mold temperature. The cast product of this invention has a fine metallurgical structure and therefore it has improved mechanical strength. The molten metal has a superheat of 50° to 80° C., where a superheat means an excess temperature beyond a melting point. If the superheat is higher than 80° C., it is impossible to obtain a fine structure giving a satisfactorily improve- strength, and if it is lower than 50° C., there is every likelihood that the molten metal may not satisfactorily flow and fill the whole cavity. By the Same reason the mold has a temperature of 350° to 430° C. in case for casting aluminum or an alloy thereof.

According to the third aspect of this invention, an inert gas is supplied into the stoke an appropriate time after the molten metal has been introduced into the cavity. The inert gas flows into a border of the solidified and unsolidified portions of the metal and thereby separates them from each other. The inert gas covers the surface of the molten metal in the stoke and thereby protects it against oxidation when the mold is opened. The separation of the molten metal allows its quick falling in the stoke and the rapid cooling of the cast product near the gate, and thereby enables a shortened casting cycle. The molten metal is, however, allowed to fall down only a limited distance so that its surface level is kept higher than that of the molten metal in the holding furnace. This makes it possible to prevent any substantial stirring of the molten metal in the holding furnace and any resulting oxidation thereof, and realize a shortened casting cycle. The higher surface level of the molten metal in the stoke can be maintained by the application of an appropriate pressure to the molten metal in the holding furnace. As the application of the pressure makes it difficult to separate the solidified and unsolidified portions of the molten metal, the use of an inert gas for that purpose is of very high importance. It is sufficient for the inert gas to have a low pressure if it is supplied into the stoke after the pressure of the molten metal in the holding furnace has been lowered.

DETAILED DESCRIPTION OF THE PREFERRED EMBODIMENTS

The invention will now be described in further detail with reference to preferred embodiments and specific examples.

EXAMPLE 1

Figure 1:
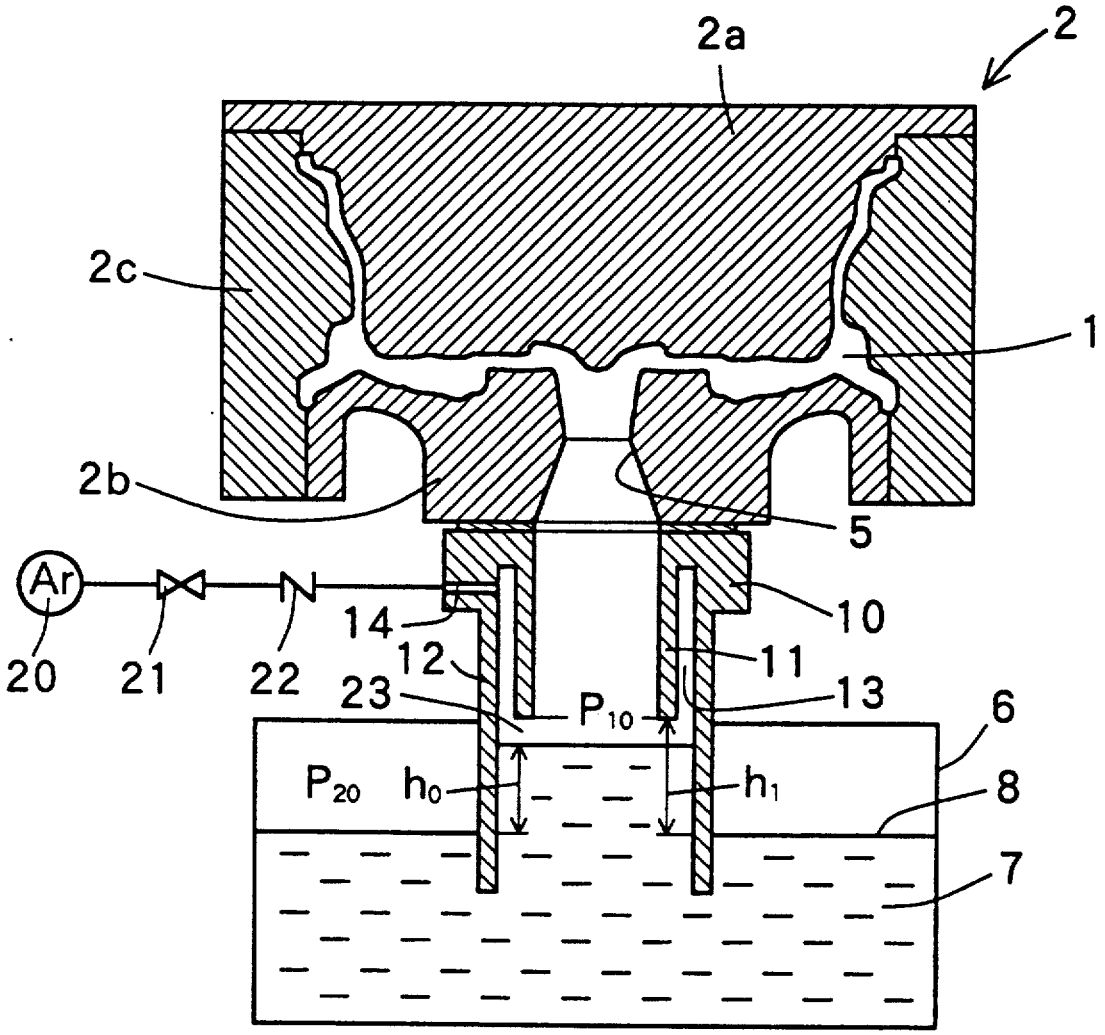
FIG. 1 is a schematic vertical sectional view of a low pressure casting machine which can be employed for carrying out a process embodying this invention.
Figure 2:
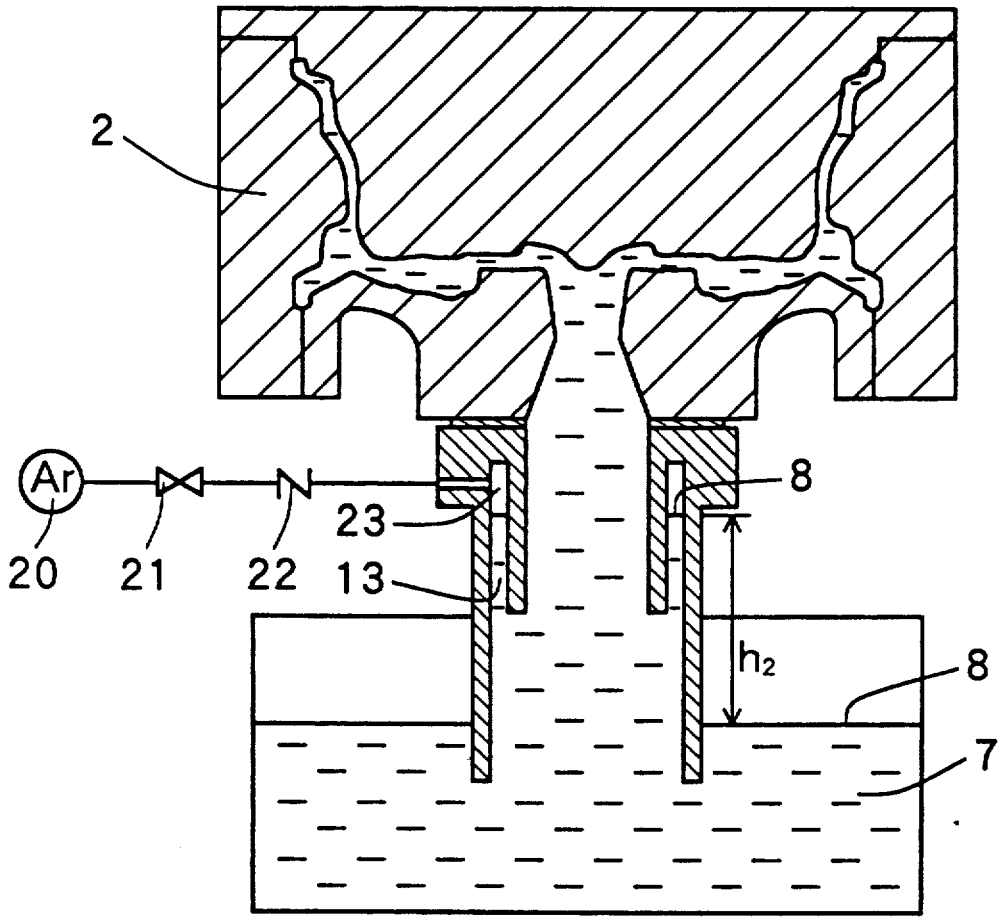
FIG. 2 is a view similar to FIG. 1, but showing molten metal raised from a holding furnace by the application of pressure.
Figure 3:
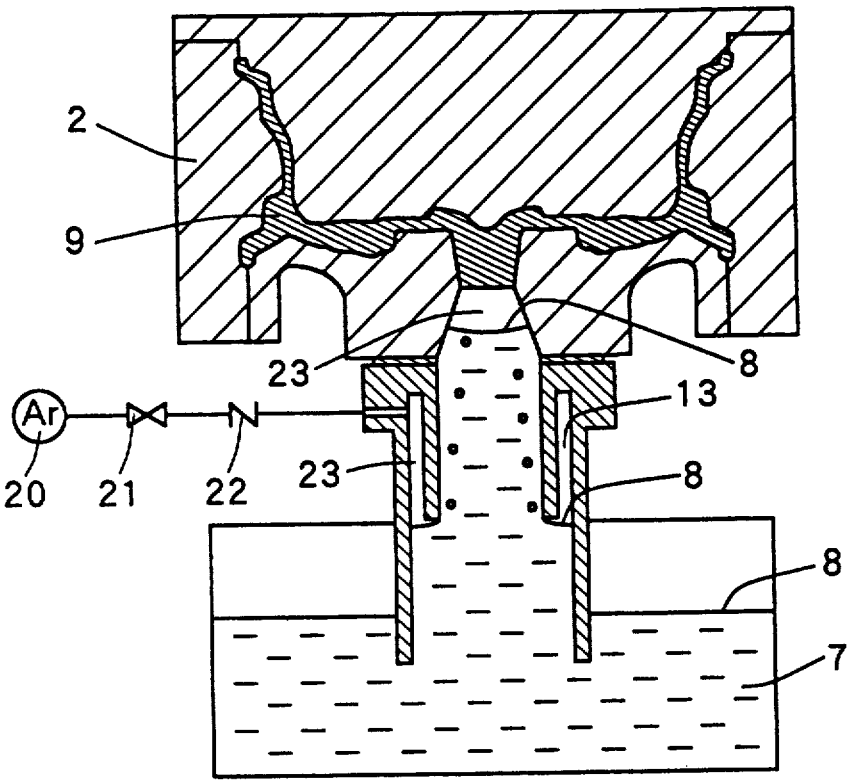
FIG. 3 is a view similar to FIG. 2, but showing the molten metal separated from a solidified product by the introduction of argon gas.

Reference is first made to FIG. 1 to 3 showing by way of example a low pressure casting machine which can be employed for carrying out a process embodying this invention. The machine includes a mold 2 defining a cavity 1 which conforms to the shape of a product to be cast. The mold 2 is formed by an upper portion 2*a*, a lower portion 2*b* and a side portion 2*c*. Also its lower portion 2*b* has a gate 5 communicating with the cavity 1. In addition, the machine includes a stoke 10 having an inner cylindrical wall 11 and an outer cylindrical wall 12. The inner cylindrical wall 11 has an upper end connected to the gate 5 and a lower end kept above the surface 8 of molten metal 7 in a holding furnace 6. The outer cylindrical wall 12 has an upper end joined to an upper portion of the inner cylindrical wall 11 and a lower end immersed in the molten metal 7. The inner and outer cylindrical walls 11 and 12 define therebetween a cylindrical space 13 having a closed upper end and an open lower end. The outer cylindrical wall 12 is provided therethrough near the upper end of the cylindrical space 13 with a hole 14 extending from the cylindrical space 13 to the outside of the wall 12. A pipeline extends from a bomb 20 containing argon gas to the hole 14 and is provided with a shutoff valve 21 and a check valve 22.

In operation, the shutoff valve 21 is opened to supply argon gas 23 into the stoke 10 through the hole 14 to replace the air in the stoke 10. The molten metal 7 is oxidized on and near its surface 8, since its surface 8 is exposed to the air until the air in the stoke 10 is replaced by the argon gas 23. After the air in the stoke 10 has been replaced by the argon gas 23, the shutoff valve 21 is closed, and pressure is applied to the molten metal in the holding furnace 6. Then the surface 8 of the molten metal 7 rises in the stoke 10, and after it has reached the lower end of its inner cylindrical wall 11, the greater part of the molten metal 7 is raised to enter the cavity 1, while driving away the argon gas, and the rest thereof enters the cylindrical space 13, while compressing the argon gas 23, as shown in FIG. 2. The volume between the check valve 22 and the lower end of the cylindrical space 13 is so designed as to be sufficiently large not to allow the molten metal entering the cylindrical space 13 to reach the hole 14 in order to protect the hole 14 and the pipeline from the molten metal 7. The molten metal 7 which has filled the cavity 1 is allowed to solidify to yield a cast product. This or the first product is, however, a respective one, since it has been cast from the molten metal containing an oxidized portion, as hereinabove stated.

Then, the shutoff valve 21 is opened to supply argon gas 23 into the cylindrical space 13. The argon gas 23 gradually lowers the molten metal in the cylindrical space 13, flows from the cylindrical space 13 into the inner cylindrical wall 11, rised through the molten metal in the inner cylindrical wall 11, and eventually separates the unsolidified metal from the solidified product 9. The unsolidified, or molten metal 7 separated from the product 9 forms free surface 8 covered with the argon gas 23. The molten metal in the holding furnace 6 is released from pressure, and the mold 2 is opened to eject the product 9, which is defective, as hereinabove stated. Then, the mold 2 is closed again and the casting operation as hereinabove described is repeated to make a second product. The second product is an acceptable one, since the molten metal 7 is covered with argon gas and not exposed to air. The same is true of any further products.

Figure 4:
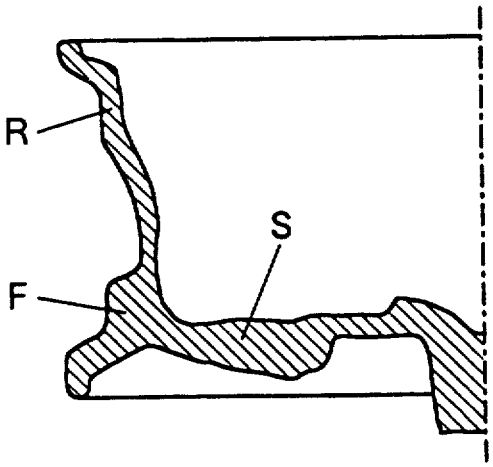
FIG. 4 is a cross sectional view of a part of an aluminum alloy wheel of automobile illustrating portions from which test specimens were taken.

FIG. 4 shows a part of an automobile wheel of aluminum alloy made in accordance with the process according to the first aspect of this invention, and conforming to JIS AC4C. Test specimens conforming to ASTM B557-E8 were taken from its spoke S, front flange F, and rear flange R, and tested for mechanical strength.

Figure 5:
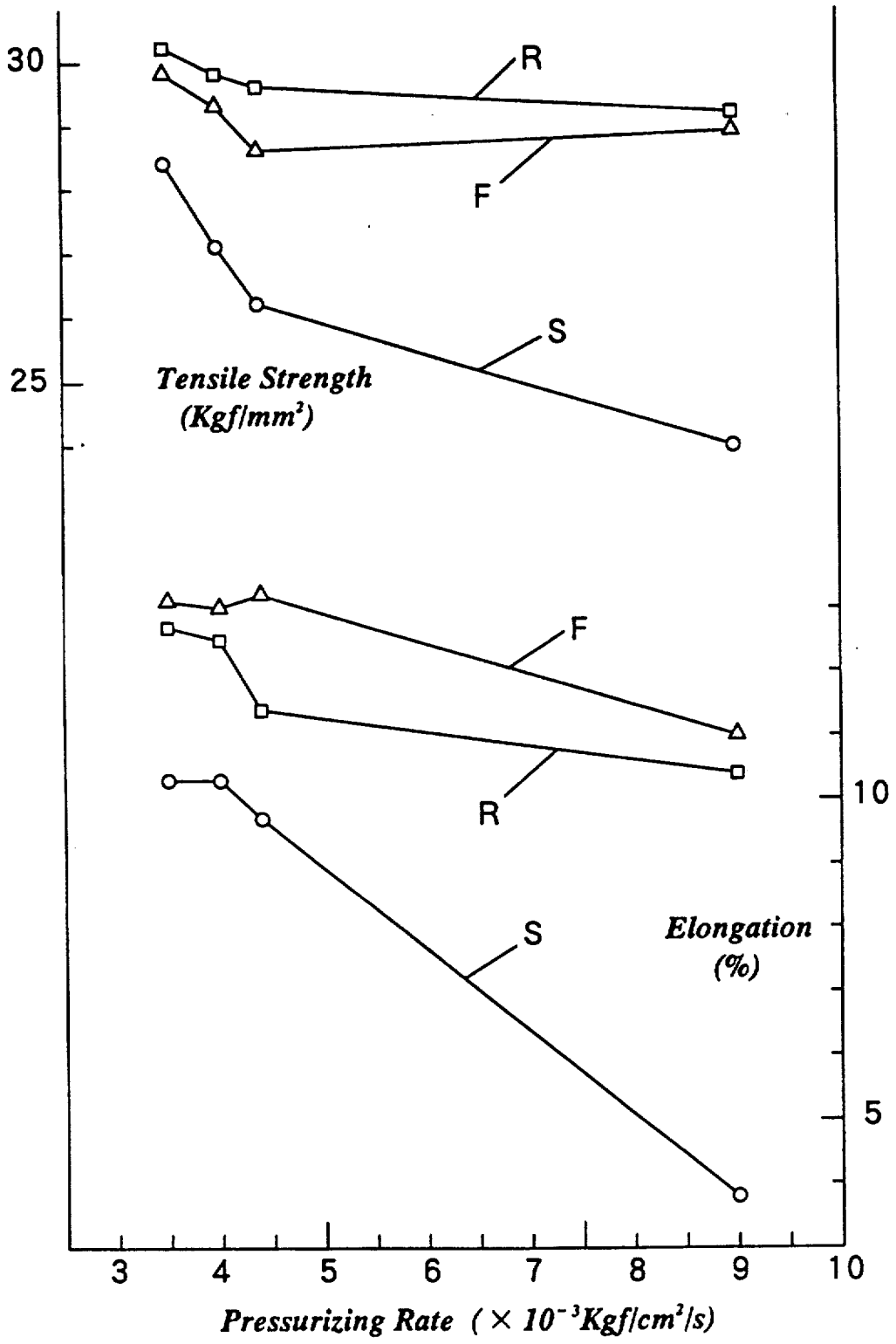
FIG. 5 is a graph showing the mechanical properties of cast products made by employing different rates for creating pressure difference.

FIG. 5 shows the results of the tests conducted on the specimens taken, as shown in FIG. 4, from aluminum alloy wheels cast by employing a mold temperature of 480° C., a molten metal temperature 710° C., and different pressurizing rates for introducing the molten metal into the mold cavity. As is obvious from FIG. 5, the lowering of the pressurizing rate brought about an increase in both tensile strength and elongation, and the products made by employing the rate not exceeding 0.006 kgf/cm$^2$/s, above all, showed greatly improved mechanical properties. The improvement was particularly great on the spokes S. However, if the rate is lower than 0.001 kgf/cm$^2$/s, the molten metal is likely to fail to fill the whole cavity satisfactorily. It is, therefore, concluded that the pressurizing rate is preferably in the range of 0.001 to 0.006 kgf/cm$^2$/s. The same can be said for a product cast from other active metals, such as Mg, Zn, Ni, Ti, Cu and alloys thereof.

Figure 6:
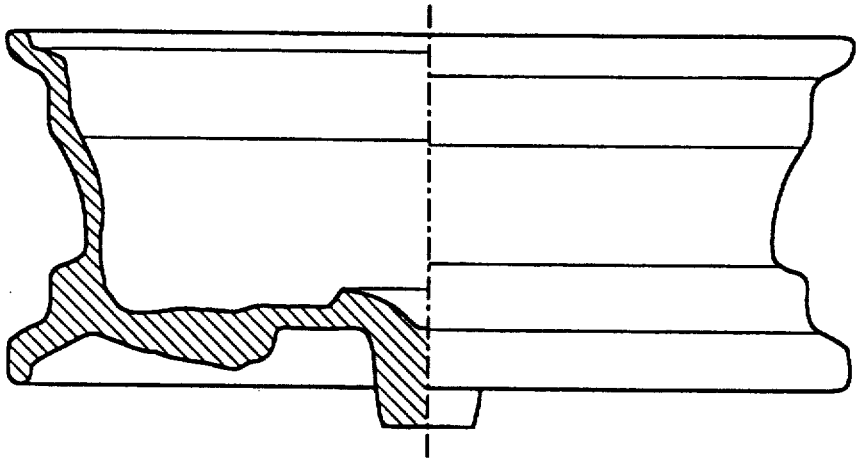
FIG. 6 is a front elevational view, half in section, of a cast product made by the process embodying this invention which shows the results of its color check.
Figure 7:
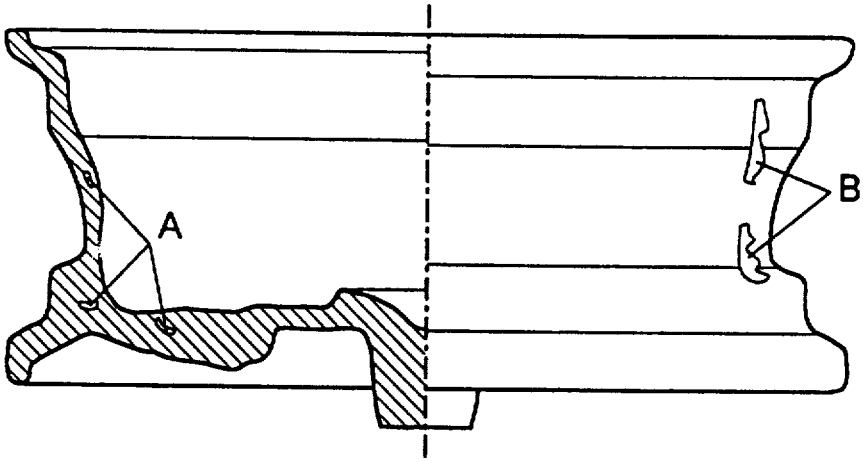
Fig. 7 Prior Art
FIG. 7 is a view similar to FIG. 6, but showing the results obtained on a product made by a conventional process.

FIG. 6 and 7 shows the results of color contrast penetrant examination conducted on the above aluminum alloy wheels. FIG. 6 shows the wheel made by employing a pressurizing rate of 0.004 kgf/cm$^2$/s and introducing argon gas in accordance with the process of this invention, while FIG. 7 shows the product of the conventional process made in the presence of air by employing a rate of 0.009 kgf/cm$^2$/s. Although casting defects A and burrs B were detected on the product of the conventional process, no such defect or burr was found on the product of the process of this invention, as is obvious from FIG. 6 versus FIG. 7. The absence of any casting defect in the product of the process of this invention was due to the smooth flow of molten metal in the cavity 1, and the absence of any burr was due to the depressed impact pressure which may occur when the molten metal fills up the cavity 1 and changes its dynamic pressure to static pressure.

Figure 8:
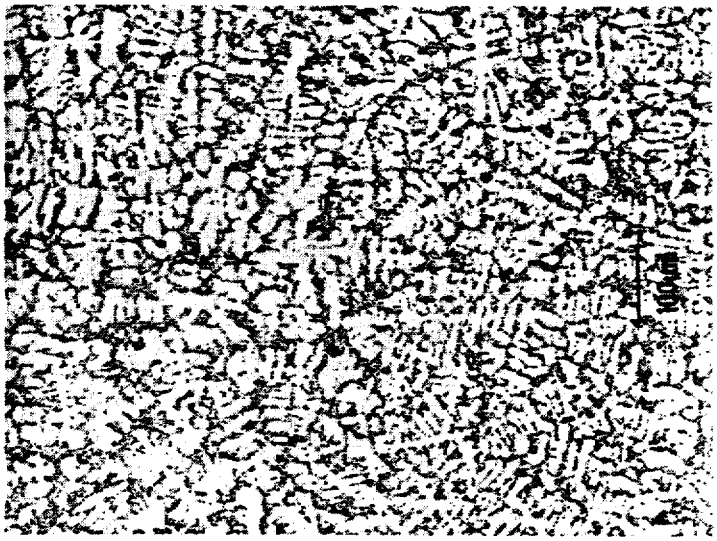
FIG. 8 is a photograph taken through a metallurgical microscope of a specimen from an aluminum alloy wheel of automobile made by the process embodying this invention.
Figure 9:
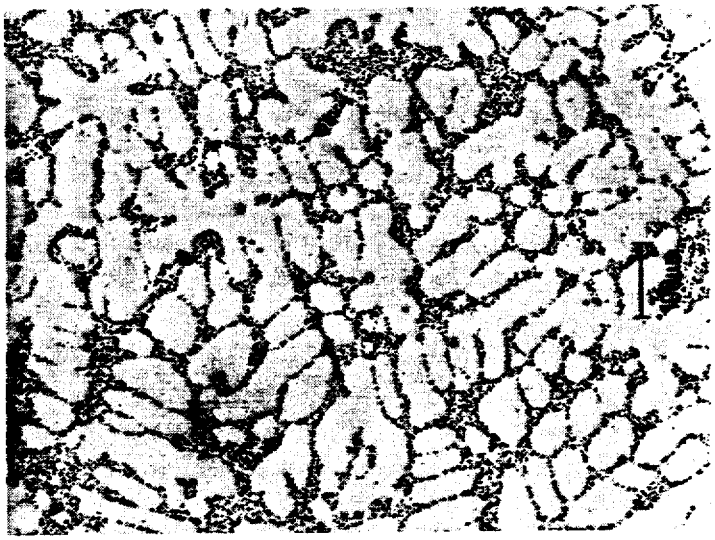
Fig. 9 Prior Art
FIG. 9 is a photograph similar to FIG. 8, but showing a product made by a conventional process.

FIG. 8 and 9 are photomicrographs of specimens taken from the spokes S of aluminum alloy wheels cast by the process of this invention employing the pressurizing rate of 0.004 kgf/cm²/s in the presence of argon gas, and the conventional process employing the rate of 0.009 kgf/cm²/s in the presence of air, respectively. As is obvious from the comparison of FIG. 8 with 9, the product of the process of this invention has a very fine metallurgical structure due to the solidification of molten metal in a highly orientated pattern.

EXAMPLE 2

Automobile wheels of aluminum alloy conforming to JIS AC4C were cast by the process according to the second aspect of this invention, and specimens conforming to ASTM B557-E8 were taken from their spoke S, front flange F, and rear flange R (see FIG. 4), then tested for mechanical properties. The test results are shown in FIG. 10 and 11.

Figure 10:
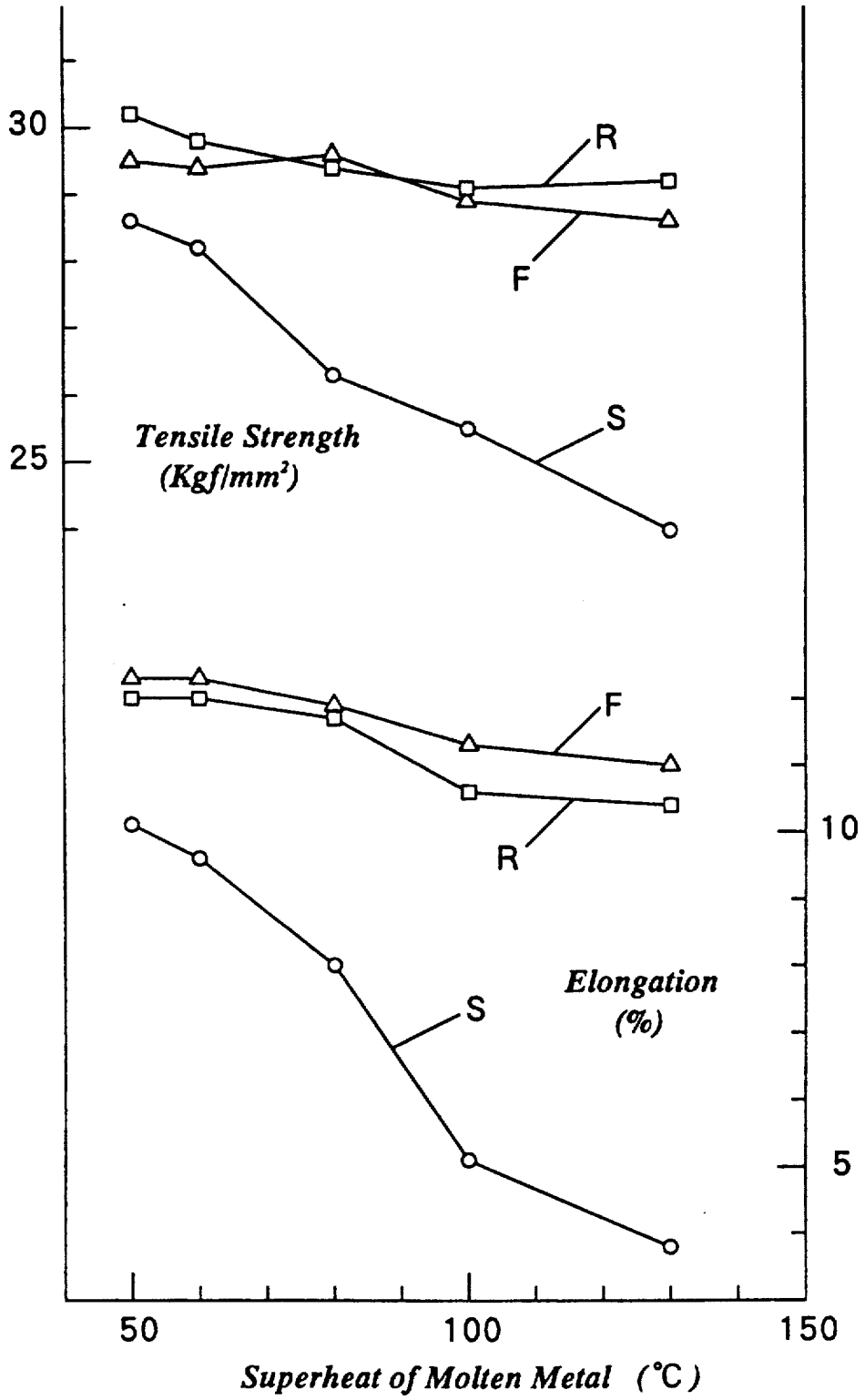
FIG. 10 is a graph showing the mechanical properties of cast products made by employing different superheats.

FIG. 10 shows the results obtained from the aluminum alloy wheels made by employing a mold temperature of 480° C., a pressurizing rate of 0.009 kgf/cm²/s, and different superheats of molten metal. As is obvious from FIG. 10, the lowering of the superheat of molten metal brought about an increase in both tensile strength and elongation, and the products made by employing the superheat not exceeding 80° C., above all, showed greatly improved mechanical properties. The improvement was particularly great on the stoke S. However, if the superheat is lower than 50° C., the molten metal is likely to fail to fill the whole cavity satisfactorily. It is, therefore, concluded that the superheat of molten metal is preferably in the range of 50° to 80° C. The same can be said for a product cast from other active metals, such as Mg, Zn, Ni, Ti, Cu and alloys thereof.

Figure 11:
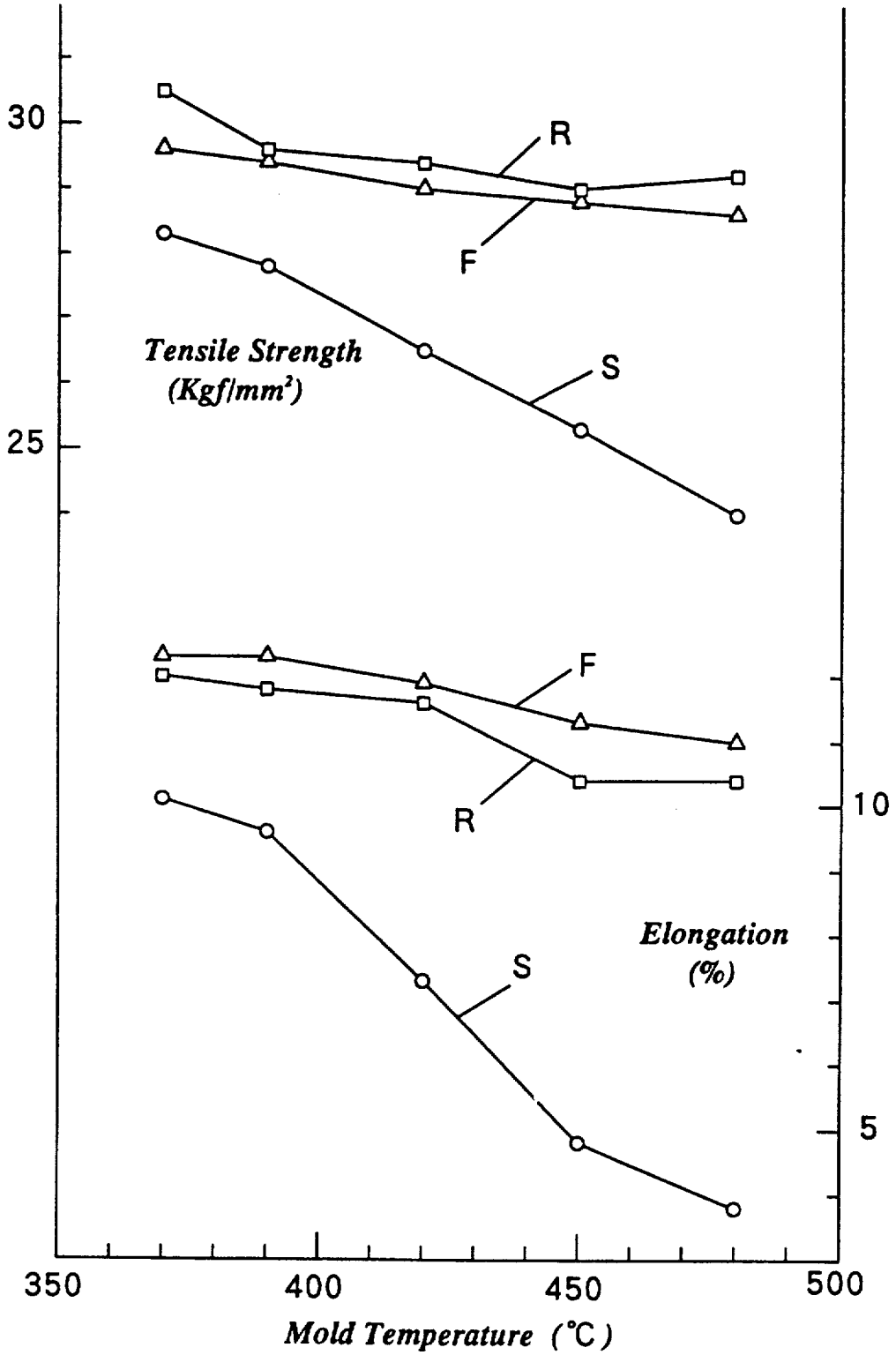
FIG. 11 is a graph showing the mechanical properties of cast products made by employing different mold temperatures.

FIG. 11 shows the results obtained from the wheels made by employing a molten metal temperature of 710° C., a pressurizing rate of 0.009 kgf/cm²/s, and different mold temperatures. As is obvious from FIG. 11, the lowering of the mold temperature brought about an increase in both tensile strength and elongation, and the products made by employing the mold temperature not exceeding 430° C., above all, showed greatly improved mechanical properties. However, if the mold temperature is lower than 350° C., the molten metal is likely to fail to fill the whole cavity satisfactorily. It is, therefore, concluded that the mold temperature is preferable in the range of 350° to 430° C.

Figure 12:
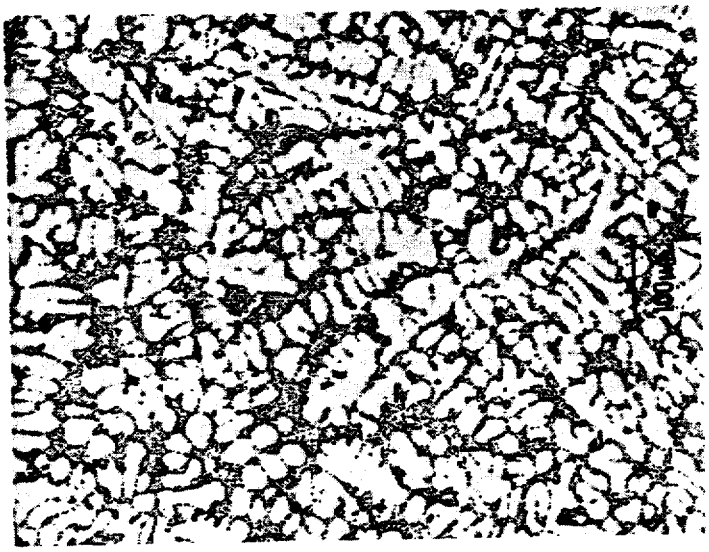
FIG. 12 is a photograph taken through a metallurgical microscope of a specimen from an aluminum alloy wheel of automobile made by a process embodying this invention.
Figure 13:
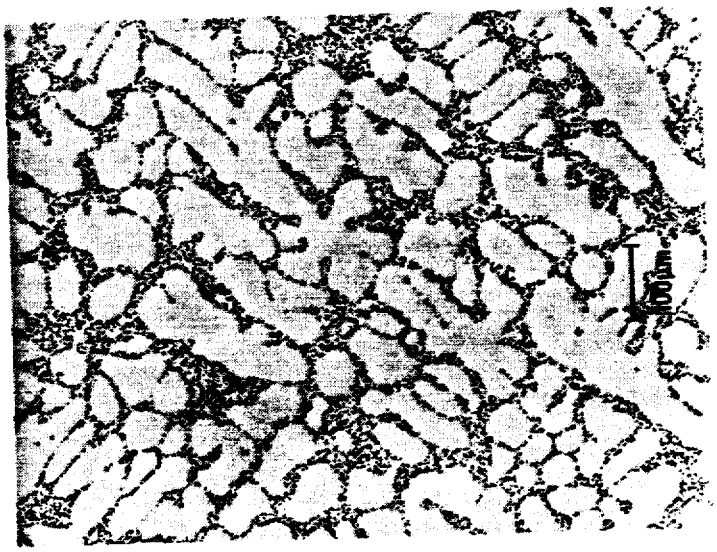
Fig. 13 Prior Art
FIG. 13 is a photograph similar to FIG. 12, but showing a product made by a conventional process.

FIG. 12 and 13 are photomicrographs of specimens taken from the stokes S of aluminum alloy wheels cast by the process of this invention employing the mold temperature of 370° C. in the presence of argon gas, and the conventional process employing the mold temperature of 480° C. in the presence of air, respectively. As is obvious from the comparison of FIG. 12 with 13, the product of the process of this invention had a very fine metallurgical structure.

EXAMPLE 3

Description will be now made of the third aspect of this invention. The shutoff valve 21 is opened to purge the stoke 10 and the cavity 1 with argon gas 23. And the pressure prevailing in the holding furnace 6 is increased to raise the molten metal in the stoke 10 so that the height h of its surface may have an initial value $h_0$ which is larger than the height of the surface of the molten metal in the holding furnace 6, but somewhat smaller than the height $h_1$ from the surface of the molten metal in the holding furnace 6 to the lower end of the inner cylindrical wall 11.

The initial value $P_{10}$ of the pressure $P_1$ of argon gas in the stoke is higher than atmospheric pressure $P_0$ by pressure $\Delta P_C$ lost through the mold cavity, i.e., $$P_{10}=P_0+\Delta P_C.$$

The pressure $P_{Ar}$ of the argon gas in the bomb 20 is higher than $P_{10}$ by pressure $\Delta P_{Ar}$ lost between the bomb 20 and the stroke 10, i.e., $$P_{Ar}=P_{10}+\Delta P_{Ar}.$$

The differences of $\Delta PC$ and $\Delta P_{Ar}$ are, however, small. The initial value $P_{20}$ of the pressure $P_2$ of the holding furnace 6 is higher than $P_{10}$ by the amount corresponding to the weight of the molten metal having the height $h_0$, i.e., $$P_{20}=P_{10}+\rho g h_0,$$

where $\rho$ stands for the density of aluminum alloy and g stands for the acceleration of gravity. As the surface 8 of the molten metal in the stoke 10 is exposed to air until the stoke 10 is purged with argon gas 23, the molten metal 7 in the stoke 10 contains an oxidized portion on and near its surface 8.

Figure 14:
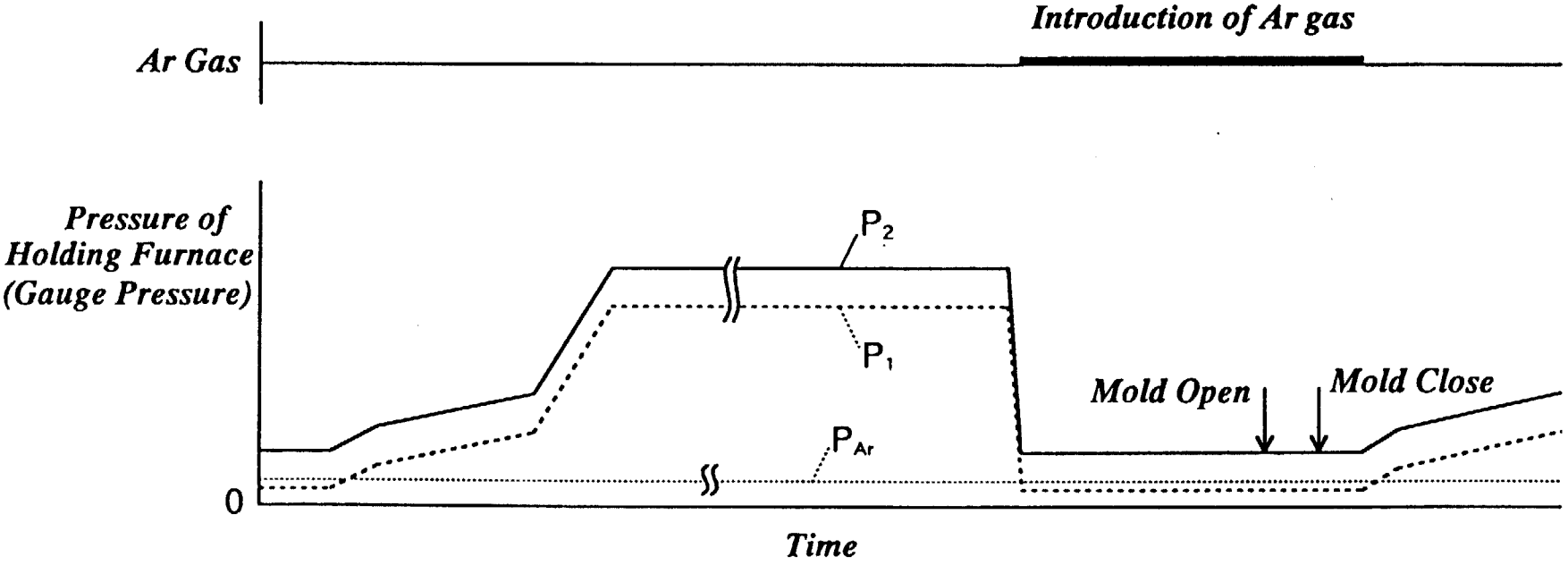
FIG. 14 is a diagram showing the timing for the application of pressure to molten metal in a holding furnace and the introduction of argon gas.

After the stoke 10 and the cavity 1 have been purged with the argon gas 23, the pressure $P_2$ of the holding furnace 6 is increased from its initial level $P_{20}$, as shown in FIG. 14, and the surface 8 of the molten metal in the stoke 10 rises from its initial level $h_0$. The surface 8 reaches the lower end of the inner cylindrical wall 11 when the pressure $P_2$ of the holding furnace 6 has been raised to a level $P_{21}$, where, $$P_{21}=P_{10}+\rho g h_1$$

Then the molten metal 7 in the stoke 10 is divided into two streams, as shown in FIG. 2. One of the streams flows into the cavity 1 through the gate 5 by driving argon gas 23 away therefrom. The other tends to enter the cylindrical space 13, but it is at first hindered by the argon gas flowing from the bomb 20. The pressure $P_2$ of the holding furnace 6 is further increased, and the pressure $P_1$ of the argon gas in the stoke 10 is thereby raised, because $P_1=P_2-\rho g h_1$. When the pressure $P_1$ of the argon gas in the stoke 10 becomes $P_1=P_{Ar}$, that is, when the pressure $P_2$ of the holding furnace 6 becomes $P_{22}$, where, $$P_{22}=P_{Ar}\rho g h_1,$$

the flow of the argon gas 23 from the bomb 20 to the stoke 10 stops and the check valve 22 closes.

The pressure $P_2$ of the holding furnace 6 is further increased, and the argon gas 23 confined between the check valve 22 and the cylindrical space 13 is so compressed that the product of its absolute pressure and volume may remain constant. When the pressure $P_2$ of the holding furnace 6 is raised to the maximum level $P_{23}$, the pressure $P_1$ of the argon gas in the stoke 10 becomes $P_1=P_{23}-\rho gh_2$, that is, the height h of the surface of the molten metal in the cylindrical space 13 reaches the maximum $h_2$. The volume from the check valve 22 to the lower end of the cylindrical space 13 is so designed that this maximum height $h_2$ does not reach the inner opening of the hole 14. On the other hand, the molten metal 7 which has filed the cavity 1 is allowed to solidify to yield a cast product 9. This, or the first product is, however, a rejective one, since it is a product of the partly oxidized molten metal.

When the first product 9 solidifies the pressure $P_2$ of the holding furnace 6 is lowered. But the molten metal 7 in the stoke 10 does not immediately fall because it contacts with the solidified product 9 intimately. What occurs is only a drop in the pressure of the molten metal 7 and in the pressure $P_1$ of the argon gas in the cylindrical space 13. Thus the argon gas 23 in the cylindrical space 13 expands by the reverse process to the time when it compressed, and the surface of the molten metal in the stoke 10 lowers its dropped to $P_1=P_{Ar}$, that is, when the pressure $P_2$ of the holding furnace 6 is decreased to $P_{22}$, where, $$P_{22}=P_{Ar}+\rho gh_1,$$

the height h of the surface of the molten metal in the cylindrical space 13 drops to the lower end of the inner cylindrical wall 11.

When the pressure $P_2$ of the holding furnace 6 is further lowered, the pressure $P_1$ of the argon gas in the stoke 10 tends to become lower than $P_{Ar}$, i.e., $P_1=P_{Ar}$, so the check valve 22 opens. As a result the pressure $P_1$ of the argon gas in the stoke is kept $P_1=P_{Ar}$, and the argon gas 23 flows from the bomb 20 to the stoke 10. The gas 23 flows from the cylindrical space 13 to the inside of the inner cylindrical wall 11, goes up through the molten metal in the wall 11, and thereby separates the unsolidified metal 7 from the solidified product 9 as shown in FIG. 3. The molten metal 7 separated from the solidified product 9 forms a free surface 8 covered with the argon gas 23.

The supply of the argon gas 23 into the stoke continues to maintain its pressure $P_1$ at $P_1=P_{Ar}$ when the pressure $P_2$ of the holding furnace 6 is $P_2<P_{Ar}+\rho gh_1$. Thus the upper portion of the stoke is eventually filled with the argon gas 23. Finally the pressure $P_2$ of the holding furnace 6 is lowered to its initial level $P_{20}$, the supply of the argon gas from the bomb 20 to the stoke stops, the check valve 22 closes, and the height h of the surface of the molten metal in the stoke becomes a height $h_3$ which is determined by the equation;

$$P_{20}=P_{Ar}+\rho gh_3.$$

Therefore, $$h_3=(P_{20}-P_{Ar})/\rho g.$$

The value of $h_3$ is slightly smaller than the initial height $h_0$, which is $h_0=(P_{20}-P_{10})/\rho g$, by $$h_0-h_3=P_{Ar}/\rho g.$$

due to the absence of a flow of argon gas from the bomb 20 to the stoke 10.

When the cast product 9 has been cooled, the mold 2 is opened to eject the first product 9, which is a defective one. When the product 9 has been ejected, the pressure acting upon the surface of the molten metal in the stoke 10 drops to nearly atmospheric pressure $P_0$, and the surface of the molten metal in the stoke 10 rises to a level $h_4$, where, $$h_4=(P_{20}-P_0)/\rho g.$$

The difference between $h_4$ and $h_3$ is small, as $$h_4-h_3=(\Delta P_C+\Delta P_{Ar})/\rho g.$$

Then, the mold 2 is closed and the height h of the surface of the molten metal in the stoke 10 drops to the initial level $h_0$. The difference between $h_4$ and $h_0$ is small as $$h_4-h_0=\Delta P_C/\rho g.$$

Then, the cavity 1 is purged with argon gas and the pressure of the holding furnace 6 is increased to introduce molten metal into the cavity 1 to cast a second product. The second product is an acceptable one, since it has been cast from the molten metal 7 kept completely away from air by argon gas. The same is true of any further product.

In the casting process as mentioned above, as the molten metal 7 and the cast product 9 are separated by the argon gas 23 supplied into the stoke 10, the surface 8 of the molten metal 7 is kept to be covered all the time with the argon gas 23 when the molten metal 7 forms a free surface, and thereby prevented its oxidation completely. And as the cast product 9 is cooled in a condition separated from the molten metal 7, it enables the rapid cooling of the cast product 9 and thereby a shortened casting cycle. Further, as the surface of the molten metal does not rise or fall widely, the molten metal in the holding furnace is prevented from substantial stirring, and also from this point of view the molten metal is prevented from its oxidation and a shortened casting cycle can be realized.

Although the invention has been described as a process in which casting is carried out by increasing the pressure prevailing in the holding furnace, it s equally applicable to a process in which casting is carried out by reducing the pressure prevailing in the cavity.

As is obvious from the foregoing, the casting process according to the first aspect of this invention, which is carried out in the presence of an inert gas by employing a low rate for creating pressure difference, can make a product having a fine metallurgical structure and thereby an improved mechanical strength which is, therefore, light in weight and substantially free from any casting defect or burr.

The process according to the second aspect of this invention, which is carried out in the presence of an inert gas by employing a low molten metal, or mold temperature, can make a product having a fine metallurgical structure and thereby an improved mechanical strength which is, therefore, light in weight. The reduction in variation of the mold temperature enables a reduction in the of its thermal expansion and contraction and thereby a prolonged mold life, as well as a reduction in the possibility of any burr being formed on the cast product.

The process according to the third aspect of this invention can prevent the oxidation of the molten metal in the stoke and the stirring of the molten metal in the holding furnace and thereby make a cast product of improved quality in a shortened casting cycle.

Although the embodiments of the present invention have been described above, various modifications are possible without departing from the spirit of the invention which is defined solely in the appended claims.

What is claimed is:

1. In a casting process which comprises;

employing a split mold defining a cavity when closed and having in its lower portion a gate communicating with said cavity, and a stoke having an upper end connected to said gate and a lower end immersed in a bath of molten active metal or its alloy in a holding furnace, increasing the pressure of said bath or decreasing the pressure of said cavity to create a pressure difference therebetween to introduce said molten metal or alloy into said cavity, and allowing said molten metal or alloy in said cavity to solidify to yield a cast product;

the improvement wherein said stoke and said cavity are filled with an inert gas before said molten metal or alloy is introduced into said cavity, and said pressure difference is created at a rate of 0.001 to 0.006 $kgf/cm^2/s$.

2. In a casting process which comprises;

employing a split mold defining a cavity when closed and having in its lower portion a gate communicating with said cavity, and a stoke having an upper end connected to said gate and a lower end immersed in a bath of molten aluminum or its alloy in a holding furnace, increasing the pressure of said bath or decreasing the pressure of said cavity to introduce said molten aluminum or alloy into said cavity, and allowing said molten aluminum or alloy in said cavity to solidify to yield a cast product;

the improvement wherein said mold is held at a temperature of 350° to 430° C. when said molten aluminum or alloy has a temperature higher than its melting point by 50° to 80° C. when introduced into said cavity.

3. In a casting process which comprises;

employing a split mold defining a cavity when closed and having in its lower portion a gate communicating with said cavity, and a stoke having an upper end connected to said gate and a lower end immersed in a bath of molten metal or its alloy in a holding furnace, increasing the pressure of said bath or decreasing the pressure of said cavity to introduce said molten metal or alloy into said cavity, allowing said molten metal or alloy in said cavity to solidify to yield a cast product, and opening said mold to remove said product therefrom;

the improvement wherein an inert gas is supplied into said stoke to effect the separation of said molten metal or alloy from said product, and the surface of said separated molten metal or alloy in said stoke is kept above that of said molten metal or alloy in said holding furnace when said product is cooled to solidify and removed from said mold.

4. The process as set forth in claim 3 wherein said bath is reduced in pressure before said inert gas is supplied into said stoke.

5. In a casting process which comprises:

employing a split mold defining a cavity when closed and having in its lower portion a gate communicating with said cavity and a stoke having an upper end connected to said gate and a lower end immersed in a bath of molten aluminum or its alloy in a holding furnace, increasing the pressure of said bath or decreasing the pressure of said cavity to introduce said molten aluminum or alloy into said cavity, and allowing said molten aluminum or alloy in said cavity to solidify to yield a cast product;

the improvement wherein filling said stoke and said cavity with an inert gas before initial introduction of said molten aluminum or alloy into said cavity, maintaining molten aluminum or alloy in said stoke, and introducing inert gas in said stoke in contact with the surface of said molten aluminum or alloy before removal of cast product and each successive introduction of molten aluminum or alloy into said cavity.

* * * * *

UNITED STATES PATENT AND TRADEMARK OFFICE

CERTIFICATE OF CORRECTION

PATENT NO. : 5,309,975
DATED : May 10, 1994
INVENTOR(S) : NOBUAKI OHNISHI et al.

It is certified that error appears in the above-indentified patent and that said Letters Patent is hereby corrected as shown below:

Claim 2, column 11, line 41, after "alloy" insert --is introduced into said cavity, and said molten aluminum or alloy--.

Signed and Sealed this

Ninth Day of August, 1994

Bruce Lehman

*Attest:*

BRUCE LEHMAN

*Attesting Officer*

*Commissioner of Patents and Trademarks*